US006730392B2

(12) United States Patent
Vetter et al.

(10) Patent No.: US 6,730,392 B2
(45) Date of Patent: May 4, 2004

(54) HARD LAYER COATED PARTS

(75) Inventors: Jörg Vetter, Bergisch Gladbach (DE); Rainer Hans, Bergisch Gladbach (DE)

(73) Assignee: Metaplas Ionon Oberflächenveredelungstechnik GmbH (DE)

( * ) Notice: Subject to any disclaimer, the term of this patent is extended or adjusted under 35 U.S.C. 154(b) by 50 days.

(21) Appl. No.: 09/804,627

(22) Filed: Mar. 9, 2001

(65) Prior Publication Data

US 2001/0031347 A1 Oct. 18, 2001

(30) Foreign Application Priority Data

Mar. 9, 2000 (EP) ..... 00104982

(51) Int. Cl.[7] ..... B32B 9/00

(52) U.S. Cl. ..... 428/216; 428/336; 428/469; 428/472; 428/697; 428/699; 428/701

(58) Field of Search ..... 428/697, 699, 428/701, 472, 469, 336, 216

(56) References Cited

U.S. PATENT DOCUMENTS

| | | | | |
|---|---|---|---|---|
| 4,357,382 | A | * | 11/1982 | Lambert et al. |
| 4,436,830 | A | | 3/1984 | Andreev et al. |
| 4,599,281 | A | * | 7/1986 | Schintlmeister et al. |
| 4,753,854 | A | * | 6/1988 | Gavrilov et al. |
| 5,030,522 | A | * | 7/1991 | Luthier et al. |
| 5,296,016 | A | * | 3/1994 | Yoshimura et al. |
| 5,700,551 | A | * | 12/1997 | Kukino et al. |
| 5,879,823 | A | * | 3/1999 | Prizzi et al. |
| 5,981,049 | A | * | 11/1999 | Ohara et al. |
| 6,033,768 | A | * | 3/2000 | Muenz et al. |
| 6,110,571 | A | * | 8/2000 | Yaginuma et al. |
| 6,284,356 | B1 | * | 9/2001 | Kiriyama |

FOREIGN PATENT DOCUMENTS

| | | |
|---|---|---|
| DE | 44 21 144 A1 | 1/1995 |
| JP | 6-346077 | 12/1994 |
| JP | 7-237010 | 9/1995 |
| JP | 11-131215 | 5/1999 |
| JP | 11-264066 | 9/1999 |
| WO | 93/24316 | * 12/1993 |

OTHER PUBLICATIONS

Patent Abstracts of Japan for 11131215, 07237010, 063460775 and 11264066.

* cited by examiner

*Primary Examiner*—Archene Turner
(74) *Attorney, Agent, or Firm*—R W Becker & Associates; R W Becker

(57) ABSTRACT

In hard layer coated parts which are coated with hard layers, this invention aims at improvements of wear resistance, oxidation behavior and lubrication properties.

In hard layer coated parts which are coated with hard layers, hard layer coated parts featured by hard layers coated with minimum 1–2 layers which contain Al, Ti, Cr, N, O.

11 Claims, No Drawings

HARD LAYER COATED PARTS

The present invention relates to wear-resistant parts that have a higher solid state lubrication capability as well as a higher wear resistance and oxidization behavior.

In the field of cutting tools, molds and mechanical components, it is popular to coat various hard layers in order to have superior wear resistance, oxidation behavior and lubrication capability. Typical TiN, TiCN layers have good wear resistance, but they still have problems relating to sufficient oxidation resistance. Furthermore, TiAlN based layers proposed by Japanese laid-open patent specification Sho62-56565 and others have good wear resistance and oxidation behavior but lubrication capability is still low. CrN, CrCN based layers have good lubrication capability, but have lower layer hardness and lower wear resistance. Like the above, conventional layers are inferior in either wear resistance or oxidization behavior or lubrication properties and still have some problems in various applications. In addition, in order to have good lubrication properties, Japanese laid-open patent Hei 5-239618 and others proposed to coat a MoS based layer, which has better lubrication properties, on the surface of hard layers; however, wear properties are poor. Similarly, conventional layers still have a certain problem and in order to solve problems with layers other than MoS based layer, Japanese laid-open patent Hei 11-156992 proposed to coat a CrN based layer as the top layer on TiAlN based layers, but this coating is not yet satisfactory in wear resistance, because the thickness of a TiAlN layer is not enough, due to limitation of the entire layer thickness, to some extent.

The object of the present invention is to improve wear resistance, oxidation behavior and lubrication properties without degrading any of those properties.

In order to realize this object, pursuant to the present invention, in hard layer coated parts which are coated with hard layers, hard layers are deposited with at least one or two layers which contain Al, Ti, Cr, N, O. Another embodiment of the present invention is characterized by at least two layers having a different nitrogen/oxygen ratio. Furthermore, superior execution modes of this invention are:

Chemical analysis of each layer which consists of a hard layer is:

$$(Al_aTi_bCR_c)\ (N_wO_{100-w})$$

however, $30 \leqq a \leqq 70, 30 \leqq b \leqq 70, 0.5 \leqq c \leqq 20$, $a+b+c=100, 70 \leqq W \leqq 99$ The number of layers is 3–1000 layers.

Thickness of each layer is 5 nm–2000 nm.

Hard layer consists of a less oxygen containing A-layer and a more oxygen containing B-layer.

Oxygen content of A-layer is (1–10) atomic %, while oxygen content of B-layer is (10–30) atomic %.

In partial or entire layers, oxygen content shows a gradient in composition.

Crystal structure of hard layers is NaCl type (face centered cubic crystalline structure).

In X-ray diffraction of the hard layer, supposing that the intensity of the diffraction of (200) plane is I(200) and the intensity of the diffraction of (111) plane is I (111), the ratio of I(200)/I(111) is greater than 1.

Morphology of hard layers is fine columnar crystal or amorphous like.

Grain diameter of fine columnar crystal is smaller than 250 nm at a distance of (1000–1500) nm from the interface between hard layer and substrate.

Compression residual stress in hard layers is less than 3.5 Gpa.

The concept of the present invention is the adoption of hard layers to which oxygen is added, while Ti, Al, Cr and N are essential elements. Naturally, Ti and Al contribute as wear resistant nitridic components and Cr contributes as a nitridic component which gives lubrication properties, however, these are not sufficient and therefore by adding oxygen both higher oxidation resistance and lubrication properties are gained.

In the field of cutting tools, first of all, oxidation behavior is further improved when Cr is added to a TiAlN substrate. In case of TiAlN, it is well known that along with oxidation, inside the lay Al diffuses to the surface and by formation of aluminium oxide, oxygen penetration from outside is suppressed resulting in an improvement of the oxidation behavior. However, in this case, when especially a shock to cutting tool is given, aluminium oxide can easily chip-off and it is difficult to avoid that effect, because underneath the aluminium oxide a very porous titanium oxide is formed. It was proven that instead of a porous titanium oxide underneath the aluminum oxide TiCr-oxide is formed by adding Cr and this oxide forms very dense layers. Accordingly, aluminum oxide formed on the top layer has sufficient adhesion and as a result the oxidation resistance is improved.

The second effect of Cr addition is an improved lubrication property. The friction coefficient of TiAlN against steel is 0.7–0.8, but by Cr addition, it can be lowered to 0.3–0.6. This friction coefficient depends on the volume of Cr added. However, if the volume of Cr addition is too high, it causes a decrease of the layer hardness resulting in inferior wear resistance and therefore it is better to set an upper limit of the volume of addition.

It is confirmed that Cr addition can improve lubrication properties and oxidation behavior of TiAlN based layers, but Cr addition is not enough and further improvement is recognized when oxygen is added. The effect of oxygen addition results, first of all, both in a drastic improvement of the oxidation behavior and drastic improvement of the lubrication properties. It is considered, the reason why the oxidation behavior is drastically improved is that alone by oxygen addition inside the layer, the crystals become finer and the layer itself and the grain boundaries become dense, respectively, so that the speed of oxygen diffusion in the form of oxygen penetration from outside is drastically suppressed. Improvement of lubrication properties has not yet been analyzed well but it is considered that the affinity of the layer surface with steel becomes lower by adding oxygen.

The second effect of oxygen addition is that wear resistance is improved by improved adhesion of layers, due to lowering of residual compressive stress in layers. Adhesion of layers is critically important especially in heavy duty cutting of in the field of forging dies. There is a trend of wear progress caused by small peeling-off of layers and when big peeling-off takes place, life times come to an immediate stop. Peeling limited load in a scratch test of an AlCrN based layer is 60–80 N, while it is improved to more than 100 N by adding oxygen.

However, when the volume of oxygen addition increases, wear resistance is improved, because of the above mentioned improvements of the oxidation behavior, of the lubrication properties and of the adhesion, but on the other hand, layer hardness itself is softened resulting in inferior abrasive wear resistance. Accordingly, it is important and desirable to make multi-layers of layers with optimized elements which contribute to oxidation behavior and lubrication properties and layers with optimum elements which contribute to abrasive wear resistance. Advantages of the above two kinds of layers are multiplied by making multiple layers.

In the next place, the reason why values were limited is explained. In case Al is less than 30 atomic %, oxidation behavior of layers becomes worse, while if it is more than 70 atomic %, AlN with hcp structure is created in the layers making layer-strength weaker and therefore undesirable. In case Ti is less than 30 atomic %, the wear resistance of layers becomes worse, while when it is more than 70 atomic %, the oxidation behavior of layers becomes worse and therefore undesirable. In case Cr is less than 0.5 atomic %, porous titanium oxide is created which does not contribute to improvement of oxidation behavior, while if it is more than 20 atomic %, layer hardness is softened and wear resistance become worse and therefore undesirable. In case the oxygen content is less than 1 atomic % in comparison to nitrogen, it does not contribute to the improvement of the oxidation behavior, of the lubrication property and of the adhesion, while if it is more than 30 atomic %, layer hardness is softened and therefore undesirable.

When the number of layers in multi-layers is less than three layers, through they show individual effects, as mentioned above, either defect become remarkable and multiplied effects cannot be observed. On the other hand, when the number of layers is more than 1000 layers, each layer thickness is too thin which does not bring multiplied effects and at the same time there is a trend of an increase of the residual stress resulting in a decrease of adhesion property of the layers and therefore undesirable. The same applies to each layer thickness; if each layer thickness is less than 5 nm, effects of advantages of each layer are weakened, while when it is more than 2000 nm, only approx. three layers are realized and therefore undesirable.

As mentioned above, the purpose of multi-layers of low oxygen-containing layers and high oxygen-containing layers is, low oxygen-layers have a smaller hardness decrease and contribute to the abrasive wear resistance, while high oxygen containing layers greatly contribute to the oxidation behavior and to the lubrication properties, though there is a trend of decrease of layer hardness. By coating these two layer types into multi-layers, both effects are multiplied and bring favorable effects. In low oxygen containing layers, when oxygen containing volume is less than 1 atomic %, adhesion with high oxygen-containing layers is weakened, while if it is more than 10 atomic %, abrasive wear resistance is degraded and therefore undesirable. On the other hand, in case of high oxygen containing layers, when oxygen containing volume is less than 10 atomic %, it does not contribute so much to the improvement of the oxidation behavior and of the lubrication properties, while if it is more than 30 atomic %, layer hardness is drastically softened and loses wear resistance and is therefore undesirable.

Simple multi-layers of these low oxygen containing layers and high oxygen-containing layers can create no problems, but adhesion of each layer is further improved either by grading the oxygen content in each layer and minimizing changes of oxygen contents at the interfaces between the single layers or by adjusting oxygen contents continuously like a sine curve.

In crystal structure, NaCl type has many sliding surfaces and layer hardness has an upper limit of approximately HV3000 and it is difficult to have higher hardnesses. On the other hand, it has better ductility, smaller creation of chippings, smaller creation of micro cracks when a shock is given and therefore a stable life time can be achieved.

Crystal orientation of layers depends on coating conditions. When there is a trend that when depositioning with relatively low energy, crystals are strongly in direction to (200) plane, while when depositioning with relatively high energy, crystals are oriented to (111) plane. It was confirmed that in case of deposition with low energy, deposition rate of layer is low, but layer density is improved and results in better oxidation behavior and wear resistance. Accordingly, it can be said that when (200) plane intensity of the diffraction is stronger than that of the (111) plane, both more superior oxidation behavior and wear resistance are gained and it is therefore more favorable. Crystal orientation does not affect the lubrication properties so much.

Crystal grain diameter of a layer is decided at fractional surface SEM and draw a line parallel to base body at a distance of 1000 nm–1500 nm from the substrate surface and prescribed by the number of grain boundaries which cross the line. If the crystal grain diameter in the layer is greater than 250 nm then both the wear resistance and the layer strength degrade and this is therefore undesirable. State of amorphous means in this case that it is not amorphous actually, however clear crystal grain boundary cannot be observed in observation of fractional surfaces. In such a case especially, a remarkable improvement of oxidation behavior is confirmed.

Residual compressive stress in layers depends on coating conditions, but when exceeding 3.5 GPa, adhesion is degraded and therefore undesirable. It should be mentioned, that the layers of this invention can have the same trend in production system of Arc Ion Plating, Sputtering, Electron beam-evaporation, Plasma Assisted CVD and a production method based on combinations of those production methods.

In the next place, a favorable embodiment in this invention is explained hereunder together with comparison examples. Sample layers of this invention and comparison samples were produced in Arc Ion Plating. Composition of AlTiCr was adjusted by adjustment of metal composition of cathode targets which are an evaporation source. Oxygen content was adjusted by mixing ratio of mixed gas of nitrogen and oxygen and also by switching over gasses. Crystal orientation is basically adjusted by coating conditions and (200) orientation layers were produced by coating conditions with 70 V bias voltage which is given to the substrate at a reactive gas pressure of nitrogen of 1 Pa, while (111) orientation layers were produced with 200 V bias voltage at a reactive gas pressure of nitrogen of 0.5 Pa. Besides, the ratio I(200)/I(111) depends a little also on layer composition and oxygen containing volume.

CHART 1

| Test piece Number | A-layer [examples of invention a:Al b:Ti c:Cr-(100-w)OwN] | B-layer [examples of invention a:Al b:Ti c:Cr-(100-w)OwN] | Number of Layers |
|---|---|---|---|
| | examples of this invention | | |
| 1 | 50Al40Ti10Cr-5095N | 50Al40Ti10Cr-25075N | 20 |
| 2 | 55Al35Ti10Cr-5095N | 55Al35Ti10Cr-25075N | 20 |
| 3 | 35Al55Ti10Cr-5095N | 35Al55Ti10Cr-25075N | 20 |

CHART 1-continued

| Test piece Number | A-layer [examples of invention a:Al b:Ti c:Cr-(100-w)OwN] | B-layer [examples of invention a:Al b:Ti c:Cr-(100-w)OwN] | Number of Layers |
|---|---|---|---|
| 4 | 65Al32Ti3Cr-5095N | 65Al32Ti3Cr-25075N | 20 |
| 5 | 33Al64Ti3Cr-5095N | 33Al64Ti3Cr-25075N | 20 |
| 6 | 40Al35Ti25Cr-5095N | 40Al35Ti25Cr-25075N | 20 |
| 7 | 50Al40Ti10Cr-2098N | 50Al40Ti10Cr-25075N | 20 |
| 8 | 50Al40Ti10Cr-5095N | 50Al40Ti10Cr-13087N | 20 |
| 9 | 50Al40Ti10Cr-5095N | 50Al40Ti10Cr-25075N | 4 |
| 10 | " | " | 100 |
| 11 | " | " | 500 |
| 12 | " | " | 900 |
| 13 | 50Al40Ti10Cr-N inclination (10-1-10)0(90-99-90)N | 50Al40Ti10Cr-N inclination (10-25-10)0(90-75-90)N | 20 |
| 14 | 40Al35Ti25Cr-5095N | 65Al32Ti3Cr-15085N | 20 |
| 15 | 33Al64Ti3Cr-7093N | 40Al35Ti25Cr-15085N | 20 |
| | comparison examples | | |
| 16 | TiN | — | 1 |
| 17 | Ti-50N50C | — | 1 |
| 18 | 50Al50TiN | — | 1 |
| 19 | TiN(500 nm) | 50Al50TiN(2500 nm) | 2 |
| 20 | 65Al35TiN | — | 1 |
| 21 | 65Al35TiN | 100 nm $MoS_2$ | 2 |
| 22 | 65Al35TiN(2000 nm) | CrN(1000 nm) | 2 |
| 23 | 50Al50Ti-70N30C | — | 1 |
| 24 | TiN | 50Al50TiN | 20 |
| 25 | 50Al40Ti10CrN | — | 1 |
| 26 | 50Al40Ti10Cr-5095N | — | 1 |
| 27 | 50Al40Ti10Cr-25075N | — | 1 |
| 28 | 50Al40Ti10Cr-5095N | 50Al40Ti10Cr-50050N | 20 |
| 29 | " | " | 1500 |

In Chart 1, examples of this invention and comparison examples are shown. Layer thickness of examples of this invention as well as in comparison examples are all 3000 nm–3200 nm.

CHART 2

| Test piece Number | Hardness [HV] | I(200)/ I(111) | Weight increase by oxidation [mg/min] | Friction Coefficient | Compressive stress [Gpa] | Grain diameter [nm] |
|---|---|---|---|---|---|---|
| examples of this invention | | | | | | |
| 1 | 2650 | 5.23 | 1.87 | 0.35 | 1.26 | 160 |
| 2 | 2700 | 4.22 | 1.11 | 0.34 | 1.35 | 148 |
| 3 | 2570 | 7.11 | 3.56 | 0.38 | 1.05 | 220 |
| 4 | 2750 | 3.25 | 1.43 | 0.33 | 2.04 | 158 |
| 5 | 2490 | 4.33 | 3.10 | 0.32 | 2.22 | 210 |
| 6 | 2500 | 2.89 | 0.98 | 0.38 | 1.59 | Amorphous |
| 7 | 2670 | 2.56 | 1.98 | 0.39 | 2.46 | 201 |
| 8 | 2710 | 2.77 | 2.31 | 0.40 | 2.41 | 175 |
| 9 | 2630 | 6.14 | 1.78 | 0.35 | 1.02 | 210 |
| 10 | 2690 | 4.28 | 1.55 | .034 | 1.96 | 143 |
| 11 | 2750 | 3.44 | 1.43 | 0.33 | 2.31 | 121 |
| 12 | 2800 | 2.49 | 1.40 | 0.33 | 2.93 | 98 |
| 13 | 2660 | 5.03 | 1.79 | 0.32 | 1.76 | 158 |
| 14 | 2600 | 4.34 | 1.23 | .038 | 1.88 | 125 |
| 15 | 2590 | 3.89 | 1.49 | 0.33 | 1.97 | 128 |
| comparison examples | | | | | | |
| 16 | 2160 | 0.25 | 85.28 | 0.87 | 1.67 | 350 |
| 17 | 2980 | 0.22 | 98.13 | 0.29 | 4.02 | 256 |
| 18 | 2700 | 2.43 | 11.67 | 0.85 | 2.89 | 341 |
| 19 | 2700 | .056 | 12.55 | 0.85 | 3.97 | 298 |
| 20 | 2750 | 3.22 | 8.05 | 0.89 | 2.11 | 253 |
| 21 | 2720 | 3.22 | 22.23 | 0.11 | 2.78 | 331 |
| 22 | 2240 | 3.22 | 15.67 | 0.29 | 2.88 | 332 |
| 23 | 3010 | 2.56 | 25.44 | 0.65 | 3.97 | 247 |

CHART 2-continued

| Test piece Number | Hardness [HV] | I(200)/ I(111) | Weight increase by oxidation [mg/min] | Friction Coefficient | Compressive stress [Gpa] | Grain diameter [nm] |
|---|---|---|---|---|---|---|
| 24 | 2450 | 2.33 | 56.81 | 0.88 | 2.85 | 286 |
| 25 | 2680 | 4.88 | 6.45 | 0.55 | 3.63 | 194 |
| 26 | 2600 | 6.22 | 3.27 | 0.53 | 2.10 | 154 |
| 27 | 1920 | 8.72 | 0.78 | 0.24 | 0.89 | Amorphous |
| 28 | 1930 | 6.32 | 0.98 | 0.28 | 1.11 | 23 |
| 29 | 1980 | 6.08 | 0.76 | 0.27 | 1.56 | Amorphous |

In Chart 2, measuring results of examples of this invention and on examples shown in Cart 1 are explained, concerning behavior, lubrication properties and wear resistance to which layer hardness contributes. For oxidation behavior, weight increase per time by oxidation by holding test pieces at 900° C. in open air was measured. The lubrication properties were analyzed by measuring the friction coefficient with carbon steel. For hardness, vickers hardness was measured by prove ball penetration depth under 1 g load, using a nano indenter method. It is very clear that examples of this invention are superior to comparison examples in every point.

CHART 3

| Test piece Number | End mill life [m] | Drill: force [N] | Number of holes | Life of inserts [hours] |
|---|---|---|---|---|
| | | examples of this invention | | |
| 1 | 65 | 125 | 760 | 1.54 |
| 2 | 75 | 120 | 950 | 1.78 |
| 3 | 48 | 127 | 578 | 1.22 |
| 4 | 81 | 135 | 1016 | 1.88 |
| 5 | 55 | 137 | 783 | 1.35 |
| 6 | 55 | 116 | 852 | 1.41 |
| 7 | 60 | 127 | 679 | 1.49 |
| 8 | 51 | 132 | 653 | 1.45 |
| 9 | 60 | 128 | 720 | 1.44 |
| 10 | 69 | 120 | 823 | 1.60 |
| 11 | 71 | 110 | 954 | 1.75 |
| 12 | 75 | 108 | 1036 | 2.01 |
| 13 | 87 | 121 | 979 | 1.86 |
| 14 | 63 | 128 | 857 | 1.56 |
| 15 | 61 | 129 | 891 | 1.60 |
| | | comparison examples | | |
| 16 | 2 | 195 | 21 | 0.11 |
| 17 | 4 | 101 | 43 | 0.24 |
| 18 | 27 | 189 | 257 | 0.75 |
| 19 | 25 | 185 | 298 | 0.77 |
| 20 | 31 | 186 | 358 | 0.81 |
| 21 | 34 | 175 | 348 | 0.75 |
| 22 | 29 | 115 | 211 | 0.45 |
| 23 | 35 | 165 | 278 | 0.71 |
| 24 | 14 | 190 | 86 | 0.33 |
| 25 | 30 | 150 | 364 | 0.85 |
| 26 | 36 | 140 | 484 | 1.03 |
| 27 | 8 | 105 | 112 | 0.16 |
| 28 | 12 | 101 | 153 | 0.31 |
| 29 | 13 | 95 | 143 | 0.22 |

In Chart 3, the tool life of examples of Chart 1 is shown for through end mill cutting under conditions below.

| | |
|---|---|
| Tool material: | 90WC-9.5 Co-0.5 Cr, WC grain Diameter 0.8 μm |
| Tool: | 6 cutting blades, diameter 8 mm end mill |

-continued

| | |
|---|---|
| Work piece material: | SKD 11 (HRC 63) |
| Cutting speed: | 100 m/min |
| Depth of cut: | 8 mm × 0.8 mm |
| Feed rate: | 50 μm/cutting edge |
| Dry or wet: | Dry cutting |

The criterion for the end of the tool life time is that cutting length at which the end mill is broken into two pieces. In any respect, the tool life times of the examples of this invention are longer than those of the comparison examples and effects of multi-layer structure with TiAlN base added by Cr and oxygen are self evident.

In Chart 3, results of hole-drilling of examples of this invention and comparison examples in Chart 1 with the conditions below are also described. Drill force is the result of the measurement at $10^{th}$ hole at initial stage of drilling. Tool life was judged when drill was broken.

| | |
|---|---|
| Tool material: | 91.5WC-8 Co-0.5 Cr, WC grain diameter 0.8 μm |
| Work piece material: | DIN 1.2344 (HRC 42) |
| Drill diameter: | 8 mm |
| Cutting speed: | 80 m/min |
| Feed rate: | 0.2 mm/rev. |
| Depth of hole: | 32 mm |
| Dry or wet; | Dry cutting |

It is evident that examples of this invention have remarkably low thrust resulting in a longer tool life.

In the third test, hard metal inserts of this invention and comparison hard metal inserts were investigated by a cutting test. These results are also described in Chart 3. In case of front milling, oxidation behavior is important, because cutting speed is high.

| | |
|---|---|
| Tool material: | P30 grade hard metal alloy |
| Insert type: | SEEN 1203 (clearance angle is 5°) |
| Work piece material: | DIN 1.2344 (HRC 22) |
| Cutting speed: | 400 m/min |
| Cutting depth: | 1 mm |
| Feed rate: | 0.1 mm/cutting edge |
| Dry or wet: | Dry cutting |

The criterion of the tool life end was the cutting time until average flank wear (VB) reached 0.4 mm.

It is obvious that the remarkable improvement of tool life of examples of this invention was confirmed.

TiAlCrON multi-layers on a base of a TiAlN layer with a modified ba addition of Cr and oxygen resulted both in an improvement of the oxidation behavior and improvement of the lubrication properties without degrading wear resistance; furthermore, an improvement of the layer adhesion caused by the lower residual compressive stress was also achieved, therefore in high speed dry cutting, superior properties can be obtained. In an application field of hot forging and others similar results seem to be possible.

What we claim is:

1. A hard layer coated part comprising at least two hard layers that contain Al, Ti, Cr, N, and O wherein the at least two hard layers have a different nitrogen/oxygen ratio and each of the at least two hard layers has the following chemical analysis:

$$(Al_aTi_bCr_c)(N_WO_{100-W})$$

where $30 \leqq a \leqq 70$, $30 \leqq b \leqq 70$, $0.5 \leqq c \leqq 20$, $a+b+c=100$, $70 \leqq W \leqq 99$.

2. A hard layer coated part according to claim 1, comprising three to one thousand hard layers.

3. A hard layer coated part according to claim 1, wherein said at least one hard layer has a thickness of 5–2000 nm.

4. A hard layer coated part according to claim 1, wherein at least two hard layers are provided, including at least one A-layer containing less oxygen and at least one B-layer containing more oxygen.

5. A hard layer coated part according to claim 4, wherein said A-layer has an oxygen content of 1–10 atomic %, and said B-layer has an oxygen content of 10–30 atomic %.

6. A hard layer coated part according to claim 4, wherein at least one of said A-layer and said B-layer has a gradient of the oxygen content.

7. A hard layer coated part according to claim 1, wherein at least one of said at least one hard layer has an NaCl type face centered cubic crystalline structure.

8. A hard layer coated part according to claim 1, wherein if said part is exposed to X-ray diffraction, the intensity of diffraction of a (200) plane is I(200), and the intensity of diffraction of a (111) plane is I(111), wherein (200) and (111) planes refer to different growth directions of a crystal lattice, and wherein the ratio of I(200)/I(111) is greater than 1.

9. A hard layer coated part according to claim 1, wherein said at least one hard layer has crystallization having fine columnar crystals or that is amorphous.

10. A hard layer coated part according to claim 9, wherein for fine columnar crystals a grain diameter of less than 250 nm is provided at a distance of 1000–1500 nm from a border line between said at least one hard layer and a substrate.

11. A hard layer coated part according to claim 1, wherein a compression stress residual of less than 3.5 GPa is provided in said at least one hard layer.

* * * * *